United States Patent [19]

Billner

[11] Patent Number: 4,760,693

[45] Date of Patent: Aug. 2, 1988

[54] PROCESS AND DEVICE FOR OPEN-END FRICTION SPINNING

[75] Inventor: Werner Billner, Ingolstadt, Fed. Rep. of Germany

[73] Assignee: Schubert & Salzer, Ingolstadt, Fed. Rep. of Germany

[21] Appl. No.: 886,982

[22] Filed: Jul. 16, 1986

[30] Foreign Application Priority Data

Jul. 30, 1985 [DE] Fed. Rep. of Germany ..... 3527212

[51] Int. Cl.[4] ..... D01H 7/892; D01H 7/898; D01H 1/135

[52] U.S. Cl. ..... 57/401; 57/408; 57/411

[58] Field of Search ..... 57/401, 406, 409, 408, 57/411, 301, 413, 263, 304

[56] References Cited

U.S. PATENT DOCUMENTS

| | | | |
|---|---|---|---|
| 4,502,272 | 3/1985 | Fuchs | 57/401 |
| 4,522,023 | 6/1985 | Stahlecker | 57/401 |
| 4,537,020 | 8/1985 | Fuchs | 57/263 |
| 4,537,021 | 8/1985 | Parker | 57/401 |
| 4,537,022 | 8/1985 | Stahlecker | 57/401 |
| 4,567,722 | 2/1986 | Stahlecker | 57/401 |
| 4,571,932 | 2/1986 | Stahlecker et al. | 57/408 X |
| 4,606,187 | 8/1986 | Stahlecker | 57/411 X |

FOREIGN PATENT DOCUMENTS 3316656 11/1984 Fed. Rep. of Germany .

*Primary Examiner*—John Petrakes
*Attorney, Agent, or Firm*—Dority & Manning

[57] ABSTRACT

In an open-end spinning process, fibers are twisted together into a yarn, alongside a suction slit, in a spinning nip formed by two friction rollers, in close proximity of each other and driven in the same direction, and subsequently drawn off therefrom. The length of the suction orifice of the suction slit is varied, before beginning the spinning process, in accordance with the thickness of the yarn to be produced. The spinning process is then started after such adjustments are made. Practice of the invention improves quality of the yarn, and saves power consumption and other resources by reducing required air consumption.

19 Claims, 2 Drawing Sheets

PROCESS AND DEVICE FOR OPEN-END FRICTION SPINNING

BACKGROUND OF THE PRESENT INVENTION

This invention generally concerns open-end friction spinning, and in particular a spinning method and device in which fibers are twisted together into a yarn alongside a suction slit extending over both a fiber feeding zone and a subsequent twisting zone. The yarn is produced in a spinning nip formed by two friction rollers in close proximity to each other and driven in the same direction. Such yarn is subsequently drawn off from the spinning nip.

It is known in the prior art to feed fibers into a nip, defined between two friction rollers in close proximity to each other and driven in the same direction, where they are twisted together into a yarn and subsequently drawn off in the axial direction of the friction rollers. For example, see German Pat. DE-OS No. 3,340,825. Formation and consolidation of the yarn takes place alongside a yarn-forming line within the nip area. The position of such yarn-forming line within the nip area depends on the diameter of the yarn to be produced.

A feeding channel is provided to convey fibers from an opening cylinder (by which they are opened in a conventional manner) into the nip area. The fibers are fed through such feeding channel either directly into the nip, or onto a casing surface of one of the friction rollers. To obtain the needed air stream both in the feeding channel and for the retention of fibers in the area of the yarn-forming line, at least one of the two friction rollers is perforated. The perforated friction roller thereby defines a suction roller which is subjected to negative air pressure (i.e. suction) over its entire length by means of a suction insert. The suction insert is equipped with a suction slit which extends alongside the yarn-forming line.

Such open-end friction spinning method is thought to be particularly well suited for the production of fine yarns, since rolling of the fiber sliver in the nip between the friction rollers makes it possible to obtain a high degree of twisting and high output speed in a relatively simple manner. However, a drawback has been found that, especially with fine yarns, spinning results did not meet expectations with regard to solidity and output speed.

SUMMARY OF THE PRESENT INVENTION

The present invention recognizes and addresses such drawback, as well as others. Hence, it is one objective of the present invention to provide a method and apparatus such that practice of this invention improves both yarn quality as well as output speed, especially for the production of fine yarns.

In one aspect, this invention improves yarn quality and output speed, while conserving air and energy consumption, by adapting the length of a suction orifice of a suction slit (preferably, but not limited to, the portion thereof in the twisting zone of the yarn-forming line) to the thickness of the yarn to be produced. Such adjustment is generally made before the beginning of the spinning process, with the actual spinning process beginning thereafter. A further aspect of the invention provides for the length of the suction orifice of the suction slit to be generally shortened as the thickness of yarn to be produced decreases.

Surprisingly, it was found that an interdependence exists between the nature of the suction in the spinning nip and the yarn number or thickenss. From this, it was determined that a definite length of the suction zone (i.e. suction orifice) in the spinning nip should be assigned for each yarn number or thickness, for best results. This not only results in great improvement of the corresponding yarn from the standpoint of strength, even at high output speeds, but also favorably influences air consumption (by lowering same) and therefore power consumption of the device. Such lowering effect of both air and power consumption arises from the general nature of the invention, which concerns adjustment of a suction orifice to some degree less than the full length (or to just the full length) of a suction slit.

Various objects of the present invention may be achieved by differing features and elements of this invention, given collections of which may comprise exemplary embodiments of a method or apparatus in accordance with features of this invention. For purposes of present disclosure, several exemplary embodiments of both the present method and apparatus are fully disclosed and described below.

In one aspect, an exemplary method in accordance with features of the present invention is directed to a method for open-end friction spinning, comprising the steps of: (a) providing a pair of rotatable friction rollers in parallel with one another and in relatively close proximity to define a spinning nip; (b) forming a plurality of perforations in the periphery of at least one of the friction rollers so as to form a suction roller; (c) disposing a suction insert inside the suction roller, the insert having a suction slit with a variable suction orifice, and the suction slit being disposed generally alongside said spinning nip; (d) providing an opening cylinder and fiber feeding channel for feeding fiber materials to the spinning nip; (e) selecting the thickness of yarn to be produced by the spinning operation; (f) adjusting the size of the suction orifice of the suction slit in accordance with the selected thickness of yarn; and (g) commencing spinning operation to produce yarn of the selected thickness, which operation includes at least feeding fiber material to the spinning nip, for yarn formation therein while rotating the friction rollers in the same direction and while supplying suction to the suction roller through the suction insert, including the suction slit with variable suction orifice thereof, and subsequently drawing formed yarn off from the spinning nip.

Yet another exemplary method in accordance with certain aspects of the present invention concerns a process for performing open-end friction spinning by which fibers are twisted together into a yarn alongside a suction slit which extends over a fiber feeding zone and a subsequent twisting zone in a spinning nip formed by two friction rollers, in close proximity of each other and driven in the same direction, and by which yarn so formed is drawn off from the spinning nip; the process including a step before the beginning of the spinning process, adapting the length of the suction orifice of the suction slit to the thickness of the yarn to be produced, the suction orifice comprising that portion of said suction slit which is open for exposure to suction during the spinning process.

Concerning an apparatus in accordance with features of the present invention, one exemplary embodiment includes an apparatus for controllably performing open-end friction spinning for the production of yarn, comprising: friction roller means for being rotatably driven during spinning operation and thereby defining a spinning nip for rolling and twisting fiber materials therein into yarn; fiber feeding means for feeding opened fiber materials to the spinning nip; suction slit means, associated with said spinning nip and having a variable-sized suction orifice, for providing suction at said nip during spinning operation; and adjustment means for selectively varying the size of the suction orifice, prior to commencement of spinning operation, in accordance with the desired thickness of the yarn to be produced.

Yet another exemplary apparatus in accordance with this invention concerns an apparatus for open-end friction spinning, comprising: two friction rollers forming a spinning nip and being rotatably driven in the same direction, at least one of the rollers being perforated to define a suction roller; a suction insert received in said perforated roller and having suction directed thereto, the insert being provided with a suction slit extending alongside a yarn-forming line, which is associated with the spinning nip and has a fiber feeding zone and a twisting zone; and means for adjusting the length of the suction slit in accordance with the thickness of yarn to be produced.

In yet another aspect of the present invention, an exemplary apparatus is directed to an insert and associated element for use with an open-end friction spinning machine for producing yarn in a spinning nip formed by two friction rollers, in close proximity of each other and driven in the same direction, comprising: a tubular suction insert received in one of said friction rollers and provided with suction during spinning operation, and having a longitudinal suction slit disposed in the periphery thereof alongside said spinning nip; and an actuable element controllably associated with the suction slit for selectively varying the portion thereof exposed to suction during spinning operation, such exposed portion defining a suction orifice the a length of which is adapted to be selectively variable in accordance with the thickness of yarn to be produced by the spinning machine.

BRIEF DESCRIPTION OF THE DRAWINGS

A full and enabling disclosure of the present invention, including the best mode thereof, is set forth in the following specification with reference to the appended figures, in which.

Use of like reference characters throughout this application and the attached figures is intended to represent same or analogous features and elements of this invention.

DETAILED DESCRIPTION OF THE PREFERRED EMBODIMENTS

Figure 1:
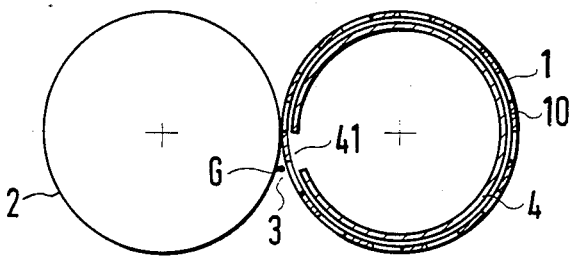
FIG. 1 illustrates a cross-section of two friction rollers forming a spinning nip.

With reference to FIG. 1, two friction rollers 1 and 2 are disposed in close proximity of each other so as to form a spinning nip 3. Rollers 1 and 2 are rotatably driven in the same direction during conventional spinning operations. Friction roller 1 is particularly constructed as a suction roller and has a casing with a plurality of perforations 10 radially disposed therein. A tubular suction insert 4 is received within the tubular casing which defines suction roller 1.

Figure 2:
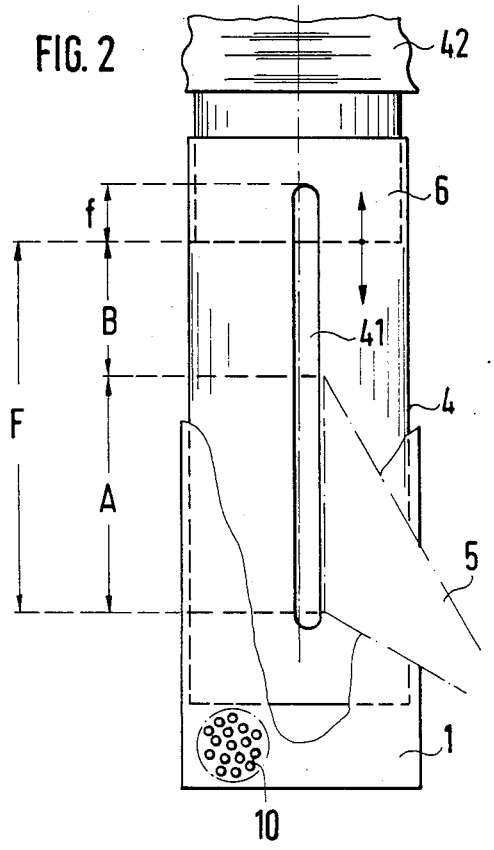
FIG. 2 illustrates a side perspective view of one exemplary friction roller of FIG. 1, embodied in accordance with the present inveniton as a suction roller and having an axial bolt included in a suction insert thereof for adjusting the suction orifice.

FIG. 2 illustrates suction roller 1 partially cut down so as to show suction insert 4 received and positioned therein. A suction slit 41 is defined in the peripheral sidewall of suction slit 4 and extends longitudinally in the direction of the rotational axis of friction roller 1. Also, suction slit 41 is positioned so as to be alongside spinning nip 3 during spinning operations. Friction roller 2 preferably has an enclosed casing as illustrated, but may alternatively be formed as a suction roller, in the same manner as friction roller 1.

The actual formation (i.e. production) of yarn G takes place in spinning nip 3 in a longitudinal yarn-forming line which runs generally parallel alongside suction slit 41. The precise radial position of such line within spinning nip 3 depends on the diameter of the yarn to be produced. Fiber feed material is first opened into single fibers by means of a conventional opening cylinder (not shown) in a manner known by those of ordinary skill in the art without further explanation. Referring again to FIG. 2, opened fiber material is fed from such opening cylinder through a fiber feeding channel 5 into spinning nip 3. The fibers are fed in such length as corresponds to the outlet length of such fiber feeding channel 5. Such function delineates a fiber feeding zone A, as illustrated in FIG. 2 at the outlet end of feeding channel 5.

Fiber feeding zone A is followed downstream therefrom (in accordance with suction provided to suction insert 4 during spinning operations) by a twisting zone B, in which a twisting motion is imparted to yarn G by the respective rotations of friction rollers 1 and 2. In fiber feeding zone A and twisting zone B of the yarn-forming line, the fiber material (or the fiber sliver) is drawn into spinning nip 3 by the suction air stream from suction insert 4 flowing through the perforations 10 in the casing of friction roller 1 and suction slit 41. During such drawing, the fiber material is rolled in spinning nip 3, and becomes consequently twisted.

In accordance with the present invention, prior to the beginning of spinning operations, the suction orifice length F (FIGS. 2 and 3) of the opening of suction slit 41 (which is the portion of slit 41 which is subjected to suction during spinning operation) is varied so as to be adapted to the thickness of yarn to be produced by the subsequent spinning process.

For such purpose, the FIG. 2 embodiment has a tubular bolt 6 disposed inside suction insert 4. Bolt 6 selectively and controllably functions as a locking element for suction slit 41. Suction insert 4 is connected in a conventional manner to a negative air pressure (i.e. vacuum) source (not shown) by means of a suction line 42 connected through bolt 6 (which is of tubular construction for such purpose). As indicated by the double-headed arrow in FIG. 2 associated with bolt 6, such bolt can be selectively positioned in the axial direction of suction insert 4. Bolt 6 makes it possible to continuously adjust the effective length (i.e. suction orifice) F of suction slit 41, which may be set precisely in accordance with the yarn to be spun before the spinning operation therefor begins. Thereafter, spinning may commence in a usual manner after such adjustment.

As illustrated by FIG. 2, the maximum available (i.e. exposed or unblocked) length of the suction orifice of suction slit 41 is selectively shortened by a length f by means of bolt 6 in the twisting zone B. The result is that spinning takes place with a specifically adjusted effective suction orifice length F. For improved yarn results, the amount of suction slit 41 which should be subjected to suction varies as a function of the particular spinning technology as well as a function of yarn thickness. It is preferred that precise length adjustments for particular pieces of equipment be determined empirically. In principle, however, it is preferred as a general proposition that the length of suction slit 41 which is exposed as a suction orifice be shortened as the thickness of the yarn to be produced is decreased. Such shortening basically occurs in (but is not limited to) twisting zone B. In another aspect, it is a general principle of this invention that the suction orifice length may be varied directly proportional to the yarn thickness to be produced.

Figure 3:
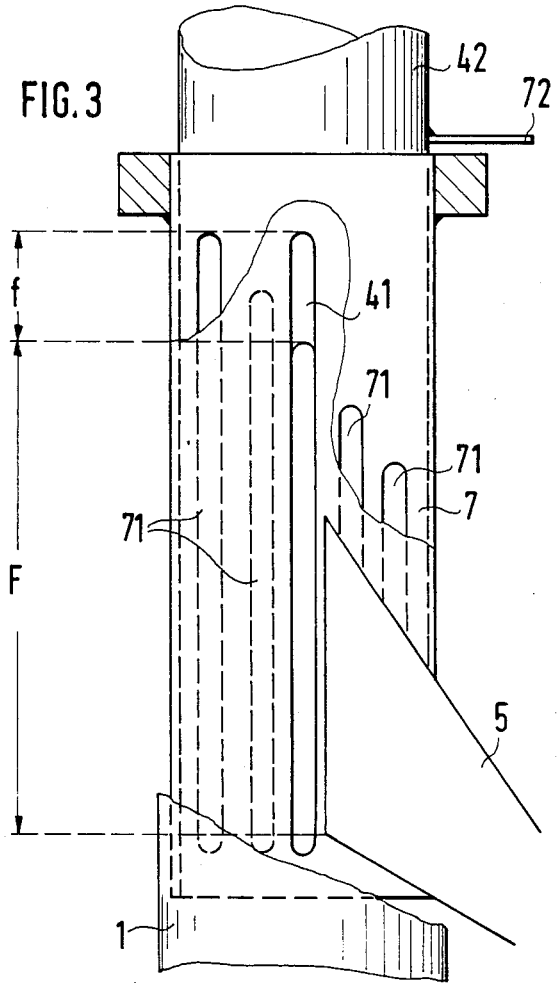
FIG. 3 illustrates a side perspective view of another exemplary embodiment of a friction roller in accordance with features of this invention embodied as a suction roller, and having a rotary disk valve included in a suction insert thereof for varying the suction orifice.

In instances where there is not sufficient room for a given bolt 6 to be slidably adjusted in an axial direction, suction may be provided for spinning operations with an alternative embodiment comprising a rotary disk valve 7 as illustrated in FIG. 3. Valve 7 entirely replaces bolt 6. A plurality of longitudinal slits 71 of staggered lengths are distributed over the circumference of the rotary disk valve, all of which are disposed parallel to suction slit 41. Thus, a precisely defined length F of the suction orifice of suction slit 41 adapted to the desired yarn thickness may be obtained. A relatively large number of such slits 71 providing a variety of lengths ensures sufficiently fine gradation for most applications, even though the FIG. 3 embodiment is not continuously variable as is the suction orifice associated with suction slit 41 of the FIG. 2 embodiment.

The FIG. 3 embodiment generally operates as follows. The circumference of rotary disk valve 7 fits relataively close to the inside diameter of suction roller 1. By rotating rotary disk valve 7 by means of a handle 72 before beginning spinning operations themselves, the proper slit 71 for a given yarn is brought into association (i.e. radial alignment) with suction slit 41, so that the length F subjected to suction (i.e. the suction orifice of suction slit 41) is determined by the length of the proper one of the suction slits 71. In other words, a slit 71 which is shorter in twisting zone B than suction slit 41 by an amount f, is aligned with slit 41 so that a selected suction orifice length F is made available for spinning.

Modifications and variations of the presently disclosed exemplary embodiments (both method and apparatus) of the present invention will occur to one of ordinary skill in the art. All such variations, as well as equivalent substitutions for particular features and elements of this invention, are intended to be included aspects of the invention.

For example, various means of selectively positioning bolt 6 or valve 7 relative suction roller 1 may be used. Also, cross-sectinal shapes and sizes of slots 41 and 71 may vary from those depicted. For example, slits 71 may be radially larger or smaller than suction slit 41 so as to provide various partial rotational schemes for the FIG. 3 embodiment. Alternatively, a relative radial portion of the roller and valve (as presently depicted, without modification) may be controlled so as to partially overlap section slit 41, and thus provide an additional aspect of variation in the size of suction orifice F other than just the length thereof.

All of the foregoing is directed to several exemplary preferred embodiments only, and includes language of description and illustration solely for such purpose, and not language of limitation which appears only in the following claims.

What is claimed is:

1. A method for open-end friction spinning, comprising the steps of:

(a) providing a pair of rotatable friction rollers in parallel with one another and in relatively close proximity to define a spinning nip;

(b) forming a plurality of perforations in the periphery of at least one of said friction rollers so as to form a suction roller;

(c) disposing a suction insert inside said suction roller, said insert having a suction slit with a variable length suction orifice, said suction orifice being defined as that portion of said suction slit which is subjected to suction during spinning operation, and said suction slit being disposed generally alongside said spinning nip;

(d) providing an opening cylinder and fiber feeding channel with an outlet end for feeding fiber materials therefrom to said spinning nip in a fiber feeding zone thereof, said fiber feeding zone being generally of a non-changing length defined by said outlet end of said fiber feeding channel;

(e) selecting the thickness of yarn to be produced by the spinning operation in a twisting zone residing in said spinning nip and substantially co-axially aligned with said fiber feeding zone in end-to-end relationship therewith, said suction slit extending substantially over both said fiber feeding zone and said twisting zone;

(f) adjusting in only said twisting zone the length of said suction orifice of said suction slit in accordance with the selected thickness of yarn; and (g) commencing spinning operation to produce yarn of said selected thickness, which operation includes at least feeding fiber material to said spinning nip for yarn formation therein, while rotating said friction rollers in the same direction and while supplying suction to said suction roller through said suction insert, including said suction slit with variable suction orifice thereof, and subsequently drawing formed yarn off from said spinning nip.

2. A method as in claim 1, wherein said adjusting step includes controllably varying the length of said variable suction orifice so that it comprises some selected length no longer than said suction slit.

3. A method as in claim 2, wherein said adjusting step includes varying the length of said suction orifice so that same is generally shortened as the selected thickness of said yarn decreases.

4. A method for open-end friction spinning, comprising the steps of:

(a) providing a pair of rotatable friction rollers in parallel with one another and in relatively close proximity to define a spinning nip;

(b) forming a plurality of perforations in the periphery of at least one of said friction rollers so as to form a suction roller;

(c) disposing a suction insert inside said suction roller, said insert having a suction slit with a variable length suction orifice, said suction orifice being defined as that portion of said suction slit which is subjected to suction during spinning operation, and said suction slit being disposed generally alongside said spinning nip;

(d) providing an opening cylinder and fiber feeding channel for feeding fiber materials to said spinning nip in a fiber feeding zone thereof;

(e) selecting the thickness of yarn to be produced by the spinning operation in a twisting zone residing in said spinning nip and axially adjacent said fiber feeding zone, said suction slit extending substantially over both said fiber feeding zone and said twisting zone;

(f) adjusting in said twisting zone the length of said suction orifice of said suction slit in accordance with the selected thickness of yarn; and (g) commencing spinning operation to produce yarn of said selected thickness, which operation includes at least feeding fiber material to said spinning nip for yarn formation therein, while rotating said friction rollers in the same direction and while supplying suction to said suction roller through said suction insert, including said suction slit with variable suction orifice thereof, and subsequently drawing formed yarn off from said spinning nip, further comprising the step of providing a tubular bolt located in an axial end of said suction slit; and wherein said adjusting step includes varying the position of said bolt within said suction insert in an axial direction thereof so as to selectively and continuously vary the length of said suction orifice of said suction slit.

5. A method for open-end friction spinning, comprising the steps of:

(a) providing a pair of rotatable friction rollers in parallel with one another and in relatively close proximity to define a spinning nip;

(b) forming a plurality of perforations in the periphery of at least one of said friction rollers so as to form a suction roller;

(c) disposing a suction insert inside said suction roller, said insert having a suction slit with a variable length suction orifice, said suction orifice being defined as that portion of said suction slit which is subjected to suction during spinning operation, and said suction slit being disposed generally alongside said spinning nip;

(d) providing an opening cylinder anf fiber feeding channel for feeding fiber materials to said spinning nip in a fiber feeding zone thereof;

(e) selecting the thickness of yarn to be produced by the spinning operation in a twisting zone residing in said spinning nip and axially adjacent said fiber feeding zone, said suction slit extending substantially over both said fiber feeding zone and said twisting zone;

(f) adjusting in said twisting zone the length of said suction orifive of said suction slit in accordance with the selected thickness of yarn; and (g) commencing spinning operation to produce yarn of said selected thickness, which operation includes at least feeding fiber material to said spinning nip for yarn formation therein, while rotating said friction rollers in the same direction and while supplying suction to said suction roller through said suction insert, including said suction slit with variable suction orifice thereof, and subsequently drawing formed yarn off from said spinning nip, further comprising the step of providing a rotary disk valve rotatably disposed within said suction insert, and having a plurality of longitudinal slits of staggered lengths formed in the periphery thereof; and wherein said adjusting step includes controllably rotating said valve within said suction insert so as to selectively align said suction slit with a selected one of said longitudinal slits, whereby the length of said suction orifice of said suction slit is varied in accordance with the length of said selected one longitudinal slit.

6. A process for performing open-end friction spinning by which fibers are twisted together into a yarn alongside a suction slit which extends over a fiber feeding zone of generally predetermined, non-changing length and a subsequent twisting zone in a spinning nip formed by two friction rollers, in close proximity of each other and driven in the same direction, and by which yarn so formed is drawn off from the spinning nip, such fiber feeding zone and twisting zone residing in such spinning nip in substantially co-axial alignment and in end-to-end relationship; said process including a step of:

before the beginning of the spinning process, adapting the length of the suction orifice of such suction slit in the portion thereof extending over said twisting zone to the thickness of the yarn to be produced, said suction orifice comprising that portion of said suction slit which is open for exposure to suction during the spinning process.

7. A process as in claim 6, wherein said adapting step includes generally shortening the length of the suction orifice of said suction slit as the desired thickness of the yarn to be produced decreases.

8. A process as in claim 6, wherein said adapting step includes manually controlling the position of an element relative said suction slit to selectively block portions of said suction slit particularly extending over said twisting zone, so as to selectively define said suction orifice with unblocked portions of said suction slit.

9. An apparatus for controllably performing open-end friction spinning for the production of yarn, comprising:

friction roller means for being rotatably driven during spinning operation and thereby defining a spinning nip for rolling and twisting into yarn fiber materials in a twisting zone of said nip;

fiber feeding means with an outlet end for feeding opened fiber material to a feeding zone of said spinning nip, said fiber feeding zone being generally of a non-changing length defined by said outlet end of said fiber feeding channel;

suction slit means, associated with said spinning nip, extending over said feeding and twisting zones thereof, and having a variable-sized suction orifice, for providing suction at said nip during spinning operation, said feeding and twisting zones residing in substantially co-axial alignment and end-to-end relationship in said spinning nip; and adjustment means for selectively varying the length of said suction orifice, in said twisting zone of said nip, prior to commencement of spinning operation, in accordance with the desired thickness of the yarn to be produced.

10. An apparatus as in claim 9, wherein:

said friction roller means includes a pair of rotatable friction rollers disposed in parallel with one another and in relatively close proximity so as to define said spinning nip, at least one of said friction rollers having a plurality of perforations formed in the periphery thereof so as to define a suction roller; and said suction slit means includes a suction insert received within said suction roller and having suction supplied thereto during spinning operation, said suction insert having a longitudinal suction slit disposed in the periphery thereof and positioned alongside said spinning nip for operative association therewith; whereby said varying of said suction orifice comprises varying the longitudinal length of said suction slit which is exposed to suction during spinning operation.

11. An apparatus as in claim 10, wherein said adjustment means includes an actuable member for selectively and controllably varying an amount of said suction slit to be blocked from having suction applied thereto during spinning operation, the unblocked remainder thereof defining said suction orifice.

12. An apparatus as in claim 9, wherein said adjustment means selectively varies said suction orifice such that the length thereof is generally shortened as the desired thickness of yarn to be produced decreases.

13. An apparatus for open-end friction spinning, comprising:

two friction rollers forming a spinning nip and being rotatably driven in the same direction, at least one of said rollers being perforated to define a suction roller;

a suction insert received in said perforated roller and having suction directed thereto, said insert being provided with a suction slit extending alongside a yarn-forming line, which is associated with said spinning nip, said suction slit extending over a generally predetermined, non-changing length fiber feeding zone and a twisting zone of said nip, such zones residing substantially in co-axial alignment and end-to-end relationship in said nip; and means for adjusting the length of that portion of said suction slit extending over said twisting zone, exposed to suction during spinning operation of said apparatus, in accordance with the thickness of yarn to be produced.

14. An apparatus for open-end friction spinning, comprising:

two friction rollers forming a spinning nip and being rotatably driven in the same direction, at least one of said rollers being perforated to define a suction roller;

a suction insert received in said perforated roller and having suction directed thereto, said insert being provided with a suction slit extending alongside a yarn-forming line, which is associated with said spinning nip, said suction slit extending over a fiber feeding zone and a twisting zone of said nip; and means for adjusting the length of said suction slit exposed to suction during spinning operation of said apparatus, in accordance with the thickness of yarn to be produced, particularly that portion of said suction slit extending over said twisting zone; wherein said adjusting means includes a sliding bolt received within an axial end of said suction insert, said bolt being adjustable in the axial direction of said suction roller so as to vary the length of said suction slit which is blocked from having suction directed therethrough.

15. An apparatus as in claim 13, wherein said adjusting means includes a rotary disk valve rotatably received within said suction insert.

16. An apparatus for open-end friction spinning, comprising:

two friction rollers forming a spinning nip and being rotatably driven in the same direction, at least one of said rollers being perforated to define a suction roller;

a suction insert received in said perforated roller and having suction directed thereto, said insert being provided with a suction slit extending alongside a yarn-forming line, which is associated with said spinning nip, said suction slit extending over a fiber feeding zone and a twisting zone of said nip; and means for adjusting the length of said suction slit exposed to suction during spinning operation of said apparatus, in accordance with the thickness of yarn to be produced, particularly that portion of said suction slit extending over said twisting zone; wherein said adjusting means includes a rotary disk valve rotatably received within said suction insert; and wherein said rotary disk valve defines slits of staggered lengths, said defined slits being distributed over the circumference of said valve and disposed parallel to said suction slit; whereby said adjusting means rotatably actuates said rotary valve so as to dispose a selected one of said slits thereof into alignment for operative association with said suction slit, such alignment defining a suction orifice of selected longitudinal length.

17. An insert and associated element for use with an open-end friction spinning machine for producing yarn in a spinning nip formed by two friction rollers, in close proximity of each other and driven in the same direction, comprising:

a tubular suction insert received in one of said friction rollers and provided with suction during spinning operation, and having a longitudinal suction slit disposed in the periphery thereof alongside said spinning nip and extending over a generally predetermined, non-changing length feeding zone and a subsequent twisting zone of such nip, such zones being substantially co-axially aligned and in end-to-end relationship; and an actuable element controllably associated with said suction slit for selectively varying the portion thereof exposed to suction during spinning operation, such exposed portion defining a suction orifice the length of which is adapted in said twisting zone only to be selectively variable in accordance with the thickness of yarn to be produced by the spinning machine.

18. An insert and associated element for use with an open-end friction spinning machine for producing yarn in a spinning nip formed by two friction rollers, in close proximity of each other and driven in the same direction, comprising:

a tubular suction insert received in one of said friction rollers and provided with suction during spinning operation, and having a longitudinal suction slit disposed in the periphery thereof alongside said spinning nip and extending over a feeding zone and a subsequent twisting zone of such nip; and an actuable element controllably associated with said suction slit for selectively varying the portion thereof exposed to suction during spinning operation, such exposed portion defining a suction orifice the length of which is adapted in said twisting zone to be selectively variable in accordance with the thickness of yarn to be produced by the spinning machine, wherein said element comprises a sliding bolt adjustably received in an axial end of said suction insert for adjustment in an axial direction thereof, such adjustment varying the length of said suction orifice by continuously varying the amount of said suction slit being blocked from suction by said element.

19. An insert and associated element for use with an open-end friction spinning machine for producing yarn in a spinning nip formed by two friction rollers, in close proximity of each other and driven in the same direction, comprising:

a tubular suction insert received in one of said friction rollers and provided with suction during spinning operation, and having a longitudinal suction slit disposed in the periphery thereof alongside said spinning nip and extending over a feeding zone and a subsequent twisting zone of such nip; and an actuable element controllably associated with said suction slit for selectively varying the portion thereof exposed to suction during spinning operation, such exposed portion defining a suction orifice the length of which is adapted in said twisting zone to be selectively variable in accordance with the thickness of yarn to be produced by the spinning machine, wherein said element comprises a rotary disk valve rotatably received within said suction insert, and having a plurality of longitudinal slits of various lengths at given intervals around the periphery thereof, said longitudinal slits being no longer than said suction slit; whereby said valve may be controllably rotated so as to selectively align one of said longitudinal slits with said suction slit to thereby define said suction orifice, and whereby selection of different ones of said longitudinal slits for alignment with said suction slit discretely varies the length of said suction orifice.

* * * * *